US009490571B1

(12) United States Patent
Annis et al.

(10) Patent No.: US 9,490,571 B1
(45) Date of Patent: Nov. 8, 2016

(54) ELECTRICAL CONNECTOR HAVING WAFERS

(71) Applicant: Tyco Electronics Corporation, Berwyn, PA (US)

(72) Inventors: Kyle Gary Annis, Hummelstown, PA (US); Mitchell Kunane Storry, Harrisburg, PA (US); Kevin Michael Thackston, York, PA (US); Kenneth P. Dowhower, Harrisburg, PA (US)

(73) Assignee: TYCO ELECTRONICS CORPORATION, Berwyn, PA (US)

( * ) Notice: Subject to any disclaimer, the term of this patent is extended or adjusted under 35 U.S.C. 154(b) by 0 days.

(21) Appl. No.: 14/736,835

(22) Filed: Jun. 11, 2015

(51) Int. Cl.
*H01R 13/514* (2006.01)
*H01R 13/52* (2006.01)
*H01R 13/6581* (2011.01)
*H01R 12/79* (2011.01)

(52) U.S. Cl.
CPC ..... *H01R 13/5219* (2013.01); *H01R 12/79* (2013.01); *H01R 13/6581* (2013.01)

(58) Field of Classification Search
CPC ..... H01R 13/514; H01R 4/2404; H01R 13/5219; H01R 23/688; H01R 13/65807; H01R 13/5202
See application file for complete search history.

(56) References Cited

U.S. PATENT DOCUMENTS 3,719,918 A * 3/1973 Kerr ..... H01R 13/746 439/319
3,835,442 A * 9/1974 Anderson ..... H01R 31/02 174/257
4,019,799 A * 4/1977 Bouvier ..... H01R 13/424 439/589
4,984,992 A * 1/1991 Beamenderfer . H01R 13/65807 439/101
5,328,388 A * 7/1994 Fust ..... H01R 13/514 439/364
6,132,256 A * 10/2000 Morsdorf ..... G01N 27/4062 439/620.21
6,471,547 B1 * 10/2002 Venaleck ..... H01R 13/58 439/607.06
6,638,110 B1 * 10/2003 Billman ..... H01R 13/514 439/108
6,739,910 B1 * 5/2004 Wu ..... H01R 13/514 439/497
6,743,050 B1 * 6/2004 Wu ..... H01R 13/6275 439/607.06
8,449,330 B1 * 5/2013 Schroll ..... H01R 13/514 439/607.06
8,845,364 B2 * 9/2014 Wanha ..... H01R 13/516 439/607.07
8,911,255 B2 * 12/2014 Scherer ..... H01R 13/6463 439/607.07
2003/0181084 A1 * 9/2003 Valasek ..... H01R 13/62933 439/157

* cited by examiner

*Primary Examiner* — Gary Paumen

(57) ABSTRACT

An electrical connector includes a shell having a cavity and a wafer assembly received in the cavity. The wafer assembly includes a wafer housing holding a plurality of electrical wafers configured to be electrically mated to a mating connector. The wafer housing has a front end and the wafers extend forward from the front end being arranged parallel to each other within the cavity. Each wafer includes a first edge and a second edge with at least one trace between the first and second edges. An interfacial seal is provided along the front end. The interfacial seal is configured to seal between the electrical connector and the mating connector. The interfacial seal provides an environmental seal for the wafer assembly.

22 Claims, 5 Drawing Sheets

ELECTRICAL CONNECTOR HAVING WAFERS

BACKGROUND OF THE INVENTION

The subject matter herein relates generally to electrical connectors having wafers.

Modern electronic systems such as telecommunications systems and computer systems often include large circuit boards called backplane boards which are rack mounted or retained in cabinets and are electrically connected to a number of smaller circuit boards called daughter cards. Electrical connectors establish communications between the backplane and the daughter cards. The daughter cards are typically separate from each other and meet different requirements for different purposes such as transmission of high speed signals, low speed signals, power, etc. that are transferred to the daughter cards from the backplane board. Cable connectors are typically electrically connected to various electrical connectors within the system. However, as the density of such systems increase, the number of cables increases. The cables add weight to the system and occupy a large amount of space. In some applications, such as military and aerospace applications, weight reduction and space reduction are important. In some applications, environmental sealing of connectors is important.

A need exists for a connector system that is cost effective and reliable that may provide a weight reduction and/or a space reduction.

BRIEF DESCRIPTION OF THE INVENTION

In one embodiment, an electrical connector is provided including a shell having a cavity and a wafer assembly received in the cavity. The wafer assembly includes a wafer housing holding a plurality of electrical wafers configured to be electrically mated to a mating connector. The wafer housing has a front end and the wafers extend forward from the front end being arranged parallel to each other within the cavity. Each wafer includes a first edge and a second edge with at least one trace between the first and second edges. An interfacial seal is provided along the front end. The interfacial seal is configured to seal between the electrical connector and the mating connector. The interfacial seal provides an environmental seal for the wafer assembly.

In another embodiment, an electrical connector is provided including a shell having a cavity and a wafer assembly received in the cavity. The wafer assembly includes a wafer housing holding a plurality of electrical wafers configured to be electrically mated to a mating connector. The wafer housing has a front end with the wafers extending forward from the front end and being arranged parallel to each other within the cavity. Each wafer includes a first edge and a second edge with at least one trace between the first and second edges. An interfacial seal is provided along the front end. The interfacial seal is sealed against each of the wafers of the wafer assembly. The interfacial seal is configured to seal to the mating connector.

In a further embodiment, an electrical connector is provided including a shell having a cavity and a wafer assembly received in the cavity. The wafer assembly includes a wafer housing holding a plurality of electrical wafers configured to be electrically mated to a mating connector. The wafer housing has a front end with the wafers extending forward from the front end and being arranged parallel to each other within the cavity. Each wafer includes a first edge and a second edge with at least one trace between the first and second edges. The electrical connector includes a flex harness having a plurality of flexible printed circuit boards (FPCBs). The FPCBs are electrically connected to corresponding wafers and extend rearward from the cavity. The flex harness has a flex seal configured to be sealed to at least one FPCB.

DETAILED DESCRIPTION OF THE INVENTION

Figure 1:
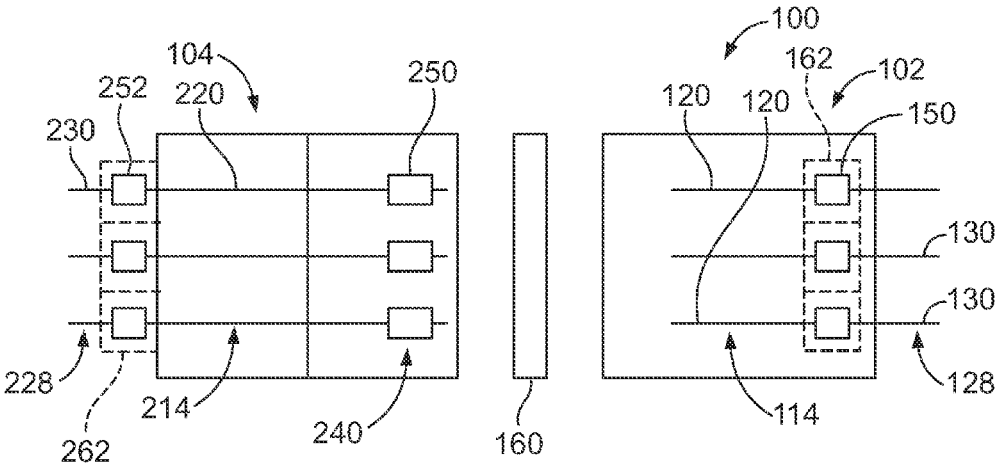
FIG. 1 is a schematic illustration of a connector system formed in accordance with an exemplary embodiment.

FIG. 1 is a schematic illustration of a connector system 100 formed in accordance with an exemplary embodiment. The connector system 100 includes a first electrical connector 102 and a second electrical connector 104 configured to be electrically connected to the first electrical connector 102. In an exemplary embodiment, the electrical connectors 102, 104 are high-speed and high density electrical connectors. The electrical connectors 102, 104 may be used as part of a computer system or a communication system, such as a backplane system. The electrical connectors 102, 104 may be electrically connected to a backplane circuit board, a daughtercard circuit board, a switch card, a line card or another electronic device. In an exemplary embodiment, the connector system 100 is part of a flexible communication system where various components may be interconnected by flexible printed circuit boards (FPCBs). For example, in the illustrated embodiment, both the first and second electrical connectors 102, 104 are terminated to ends of FPCBs. In other various embodiments, one or more of the electrical connectors 102, 104 may be mounted to a circuit board. In other various embodiments, one or more of the electrical connectors 102, 104 may be terminated to ends of cables.

The FPCBs allow flexibility in the design and system layout. The electrical connectors 102, 104 establish communication between the various components. The connector system 100 may be designed to meet different requirements for different purposes such as transmission of high speed signals, low speed signals, power, and the like between the various components. Because connector space may be limited on circuit boards, the FPCBs allow electrical connection without the need for one or more circuit boards. For example, midplane boards, daughtercards and/or backplanes may be eliminated in the communication system with the use of the FPCBs.

The electrical connectors 102, 104 offer flexibility and customization within the connector system 100 by using modular components which can be used in a variety of combinations. For example, the electrical connectors 102, 104 use the FPCBs to route between various components or connectors. One or both of the electrical connectors 102, 104 may use printed circuit electrical wafers at mating interfaces thereof (in the illustrated embodiment, the first electrical connector 102 uses wafers, while the second electrical connector uses contacts to mate to the wafers at a separable interface; however the second electrical connector may have wafers at the mating interface with the FPCBs). The electrical connectors 102, 104 provide a flexible platform to provide the density, data throughput, and signal integrity required for various applications in computer, communications, military, medical, industrial control or other industries. The use of the printed circuit electrical wafers allows for cost effective sequencing and electrical customization of the connectors 102, 104. The wafers can be manufactured specifically for differential or single ended performance and the impedance, propagation delay, and crosstalk of the connector can be altered per customer requirements. The electrical connectors 102, 104 are scalable and may include any number of wafers, such wafers may be signal wafers, power wafers or signal and power wafers. The wafers are not necessarily all of the same type; and further, each can be functionally independent of the others. That is, the connectors 102, 104 can include a mix of electrical wafers that perform different functions. The connectors 102, 104 can be customized to a particular need simply by loading the appropriate wafers in a particular slot or location in the connector 102, 104. For instance, in an exemplary embodiment, the connectors 102, 104 may be configured to carry signal information on some wafers and also transfer power on other wafers. Further, in various embodiments, the signal wafers may be high density signal wafers, low density signal wafers and/or hybrid signal wafers configured to carry both high speed signals and low speed signals. In addition, the signal wafers may carry different numbers of signal lines.

In an exemplary embodiment, the electrical connector 102 includes a wafer stack 114 having a plurality of electrical wafers 120 arranged parallel to each other. Each wafer 120 includes traces extending between a first edge and a second edge (and optionally a third edge or more edges). The traces may include pads at or near the first and second edges for electrical terminations to the traces. Optionally, the edges may be at opposite sides from each other and thus define a straight pass through the wafer 120 of the power or signal. Alternatively, the edges may be perpendicular to each other.

The electrical connector 102 includes a flex harness 128 including a plurality of FPCBs 130. The FPCBs 130 are electrically connected to corresponding wafers 120 at mating interfaces 150. The FPCBs 130 may include traces, such as signal traces, ground traces, power traces and the like. Optionally, as in the illustrated embodiment, the FPCBs 130 may be soldered directly to the wafers 120 at the interfaces 150. For example, the traces of the FPCBs 130 are electrically connected to the pads of corresponding traces of the wafers 120 of the wafer stack 114, such as at the second edge. Alternatively, the FPCBs 130 may be electrically connected to the wafers 120 via one or more contact sub-assemblies at the mating interfaces 150. For example, the contact sub-assembly(ies) may be terminated to the wafers 120 and the FPCBs 130 may be connected to the contact sub-assembly(ies).

In an exemplary embodiment, an interfacial seal 160 is provided between the first electrical connector 102 and the second electrical connector 104. The interfacial seal 160 may be attached to the first electrical connector 102, such as at the mating end of the electrical connector 102, or may be attached to the second electrical connector 104. The interfacial seal 160 may provide a sealing interface with the second electrical connector 104. Optionally, the interfacial seal 160 may seal to each of the wafers 120 individually.

In an exemplary embodiment, the first electrical connector 102 includes one or more flex seals 162 at the rear end of the electrical connector 102. The flex seal(s) 162 provide a sealing interface for the FPCBs 130. Optionally, each FPCB 130 may have its own designated flex seal 162. The flex seal 162 may seal to the FPCB 130. The flex seal 162 may seal to the corresponding wafer 120. The flex seal 162 may seal to the shell or housing of the electrical connector 102. In other various embodiments, the electrical connector 102 includes a single flex seal 162 which may be referred to as a harness seal configured to seal the flex harness to the FPCBs 130 and/or the housing. For example, the flex seal 162 may be potting material, such as epoxy material, that fills the rear end of the electrical connector where the FPCBs exit the shell or housing. Other types of flex seals may be provided in alternative embodiments. The flex seal 162 may provide an environmental seal. The flex seal 162 may provide strain relief for the FPCBs 130.

The electrical connector 104 includes a wafer stack 214 having a plurality of electrical wafers 220 arranged parallel to each other. Each wafer 220 includes traces extending between edges of the wafer 220. The traces may include pads at or near the corresponding edges for electrical terminations to the traces. Optionally, the edges may be at opposite sides from each other and thus define a straight pass through the wafer 220 of the power or signal. Alternatively, the edges may be perpendicular to each other.

The electrical connector 104 includes at least one contact sub-assembly 240 terminated to the wafer stack 214. In the illustrated embodiment, a single contact sub-assembly 240 is terminated to the wafer stack 214 as a unit; however, in alternative embodiments, individual contact sub-assemblies 240 may be separately terminated to each corresponding wafer 220. In an exemplary embodiment, the contact sub-assembly 240 includes a rigid printed circuit board (RPCB) and contacts extending from the RPCB. Housings may be mounted to both sides of the RPCB to hold the contacts. The contact sub-assembly 240 is terminated to the wafer stack 214 such that the contacts are terminated to corresponding traces of the wafers 220 at mating interfaces 250. Optionally, one or more of the edges of each of the wafers 220 may define separable interfaces with the contacts of the contact sub-assembly 240. The wafers 120 may extend from the housing of the contact sub-assembly 240.

The electrical connector 104 includes a flex harness 228 having a plurality of FPCBs 230. The contact sub-assembly 240 is provided between the flex harness 228 and the wafer stack 214 and provides the electrical connection therebetween. Each FPCB 230 may be separately terminated to the wafer 220 at corresponding mating interfaces 252. The FPCBs 230 have traces. The FPCBs 230 are terminated to the wafers 220 such that the traces of the FPCBs 230 are electrically connected to corresponding contacts of the contact sub-assembly 240 via the traces of the wafers 220.

In an exemplary embodiment, the second electrical connector 104 includes one or more flex seals 262 at the rear end of the electrical connector 104. The flex seal(s) 262 provide a sealing interface for the FPCBs 230. Optionally, each FPCB 230 may have its own designated flex seal 262. The flex seal 262 may seal to the FPCB 230. The flex seal 262 may seal to the corresponding wafer 220. The flex seal 262 may seal to the shell or housing of the electrical connector 104. In other various embodiments, the electrical connector 102 includes a single flex seal 262 that seals each of the FPCBs 230. For example, the flex seal 262 may be potting material, such as epoxy material, that fills the rear end of the electrical connector where the FPCBs 230 exit the shell or housing. Other types of flex seals may be provided in alternative embodiments. Optionally, an interfacial seal (not shown) may be provided at the mating end of the electrical connector 104 for sealing to the first electrical connector 102.

Figure 2:
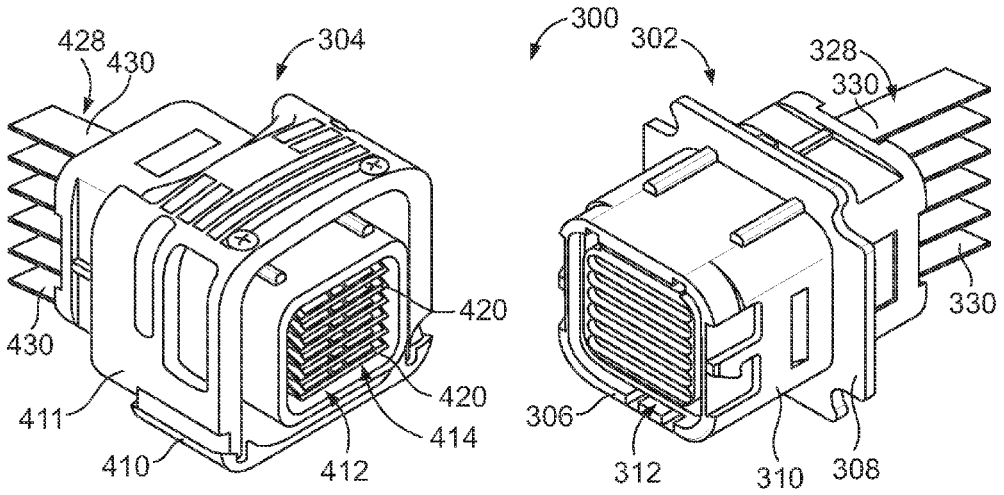
FIG. 2 illustrates a connector system formed in accordance with an exemplary embodiment.

FIG. 2 illustrates a connector system 300 formed in accordance with an exemplary embodiment. The connector system 300 includes a first electrical connector 302 and a second electrical connector 304 configured to be electrically connected to the first electrical connector 302. In an exemplary embodiment, the electrical connectors 302, 304 are modular rectangular connectors for use in aerospace or military applications and may have size, shape and mating interface requirements corresponding to the European standardized EN4165 connectors. For example, the electrical connectors 302, 304 may have features similar to DMC-M connectors designed and developed by TE Connectivity.

Figure 3:
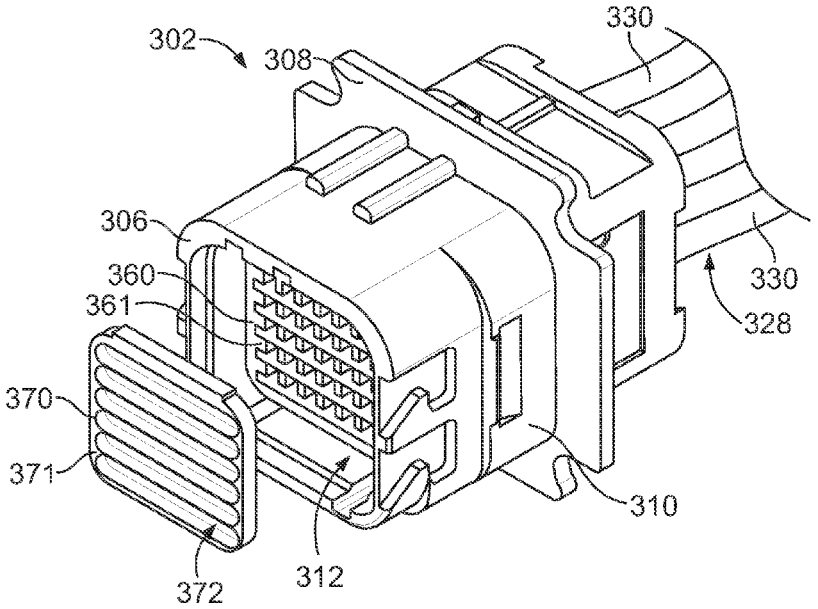
FIG. 3 is a front perspective view of an electrical connector in accordance with an exemplary embodiment.
Figure 4:
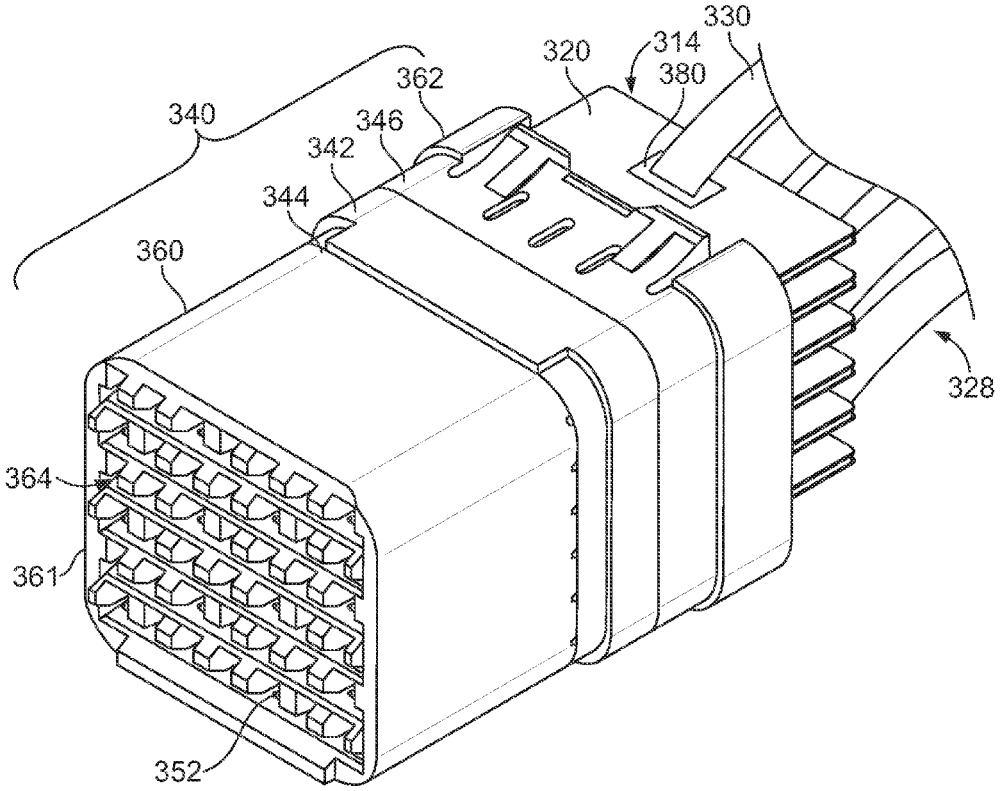
FIG. 4 is a front perspective view of a portion of the electrical connector shown in FIG. 3.

FIG. 2 is a rear perspective view of the first electrical connector 302 poised for mating with the second electrical connector 304. FIG. 3 is a front perspective view of the electrical connector 302. FIG. 4 is a front perspective view of a portion of the electrical connector 302. In an exemplary embodiment, the electrical connector 302 includes a shell 310 having a cavity 312. The shell 310 has a mating end 306 and a flange 308 for mounting the shell 310 in a device, panel or other structure. The electrical connector 302 is shown without the shell 310 in FIG. 4. In an exemplary embodiment, the shell 310 is conductive and provides electrical shielding for the components therein. The shell 310 may be a die cast housing. The shell 310 may be plastic. The shell 310 may define an outer housing of the connector.

The electrical connector 302 includes a wafer assembly 314, which is received in the cavity 312. The wafer assembly 314 includes a plurality of electrical wafers 320 stacked together and arranged parallel to each other within the cavity 312. Optionally, the wafers 320 may be sealed at the shell 310, such as at the rear of the shell 310 with a seal or gasket received in the cavity 312 or with potting or another compound in the cavity 312. Each wafer 320 includes traces 322 extending between opposite edges of the wafer 320 (for example, front and rear edges of the wafer 320). The traces 322 may include pads 324 at or near the first and/or second edges for electrical terminations to the traces 322.

Figure 5:
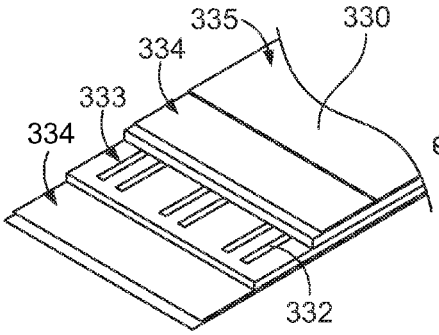
FIG. 5 illustrates an exemplary flexible printed circuit board (FPCB) of the electrical connector in accordance with an exemplary embodiment.

The electrical connector 302 includes a flex harness 328 including a plurality of FPCBs 330. The FPCBs 330 are electrically connected to corresponding wafers 320. FIG. 5 illustrates an exemplary FPCB 330. The FPCB 330 includes signal traces 332 on a signal layer 333; however, the FPCB 330 may include power traces on a power layer. The signal traces 332 may have any layout. For example, the signal traces 332 may be arranged in a single row or in multiple rows. The signal traces 332 may be arranged in pairs. The FPCB 330 includes ground layers 334, such as on opposite sides of the signal layer 333. Optionally, ground traces may be provided on the same layer with the signal traces 332 and arranged between corresponding signal traces 332, such as for electrical shielding therebetween. The FPCB 330 includes cover layers 335 on the outer sides of the FPCB 330. Insulating layers may be provided between the signal layer 333 and the ground layers 334 and/or between the ground layers 334 and the cover layers 335. In an exemplary embodiment, the signal layer 333 and ground layers 334 are exposed for termination to the corresponding wafer 320. For example, the FPCB 330 may be laser ablated to expose the ground layer 334 and the signal traces 332. Exposing the various layers may create a stepped FPCB 330 at the end.

Figure 6:
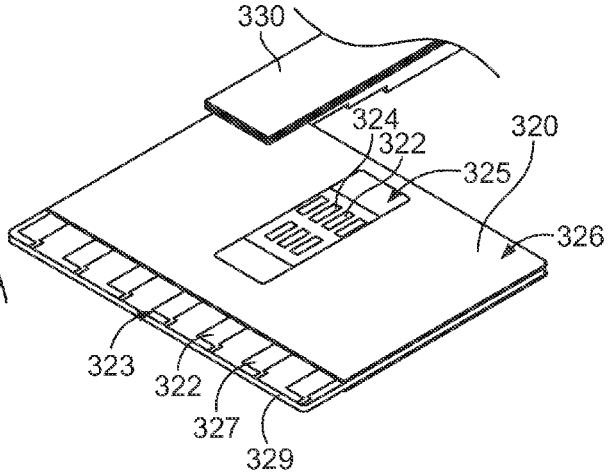
FIG. 6 shows the FPCB being terminated to a wafer of the electrical connector in accordance with an exemplary embodiment.

FIG. 6 shows the FPCB 330 being terminated to the wafer 320 in accordance with an exemplary embodiment. The wafer 220 includes the signal traces 322 on a signal layer 323; however, the wafer 320 may include power traces on a power layer. The signal traces 322 may have any layout (the layout shown in FIG. 6 is a different layout than the layout shown in FIG. 5 showing the traces 322 in multiple rows rather than a single row). The signal traces 332 may be arranged in pairs. The wafer 320 includes ground layers 325, such as on opposite sides of the signal layer 323. The wafer 320 includes cover layers 326 on the outer sides of the wafer 320. In an exemplary embodiment, the signal layer 323 and ground layers 325 are exposed for termination of the FPCB 330 thereto. Optionally, the pads 324 of the signal traces 322 (and/or ground traces) are exposed. The signal traces 322 are routed to the first edge 329 with mating pads 327 exposed at the first edge 329. During assembly, the FPCB 330 is configured to be terminated to the wafer 320. For example, the FPCB 330 may be soldered directly to the wafers 320. For example, the signal traces 332 of the FPCB 330 are aligned with the pads 324 and the exposed portion of the ground layers 334 of the FPCB 330 are aligned with the exposed portions of the ground layer 325 of the wafer 220. Solder is provided between the signal and ground layers to electrically connect the FPCB 330 to the wafer 220. Optionally, because the FPCB 330 is stepped, the FPCB 330 may be angled relative to the wafer 320 to ensure that each of the layers of the FPCB mate with each of the layers of the wafer 320. Returning to FIGS. 2, 3 and 4, each FPCB 330 within the flex harness 328 is terminated to the corresponding wafer 320 in the wafer assembly 314. Optionally, the FPCB 330 may be sealed using one or more flex seals.

Figure 7:
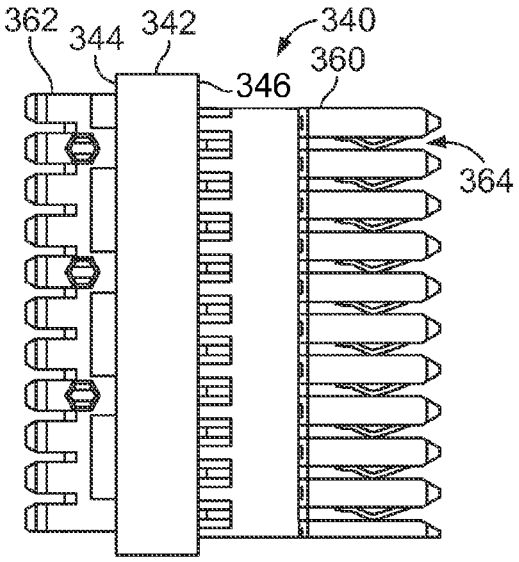
FIG. 7 illustrates an exemplary embodiment of a contact sub-assembly of the electrical connector in accordance with an exemplary embodiment.
Figure 8:
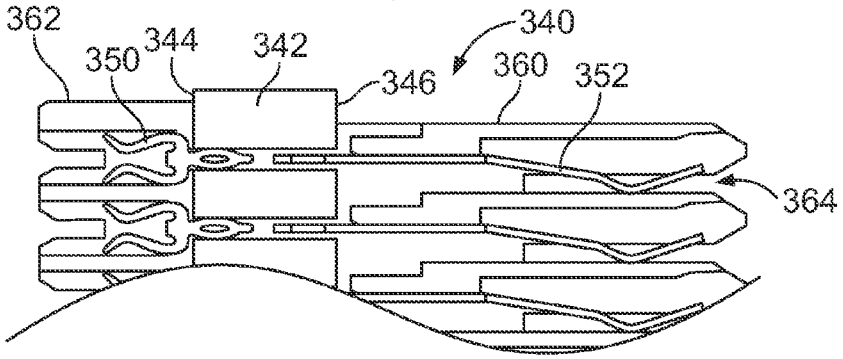
FIG. 8 is a cross-sectional view of a portion of the contact sub-assembly shown in FIG. 7.

In an exemplary embodiment, the electrical connector 302 includes a contact sub-assembly 340 provided at the front of the wafer assembly 314. FIG. 7 illustrates an exemplary embodiment of the contact sub-assembly 340. FIG. 8 is a cross-sectional view of a portion of the contact sub-assembly 340. The contact sub-assembly 340 includes a RPCB 342 having a first side 344 and a second side 346. The RPCB 342 may include plated vias 348 therethrough. The contact sub-assembly 340 includes wafer contacts 350 received in corresponding vias 348 and extending from the first side 344 of the RPCB 342 and mating contacts 352 received in corresponding vias 348 and extending from the second side 346 of the RPCB 342. For example, the contacts 350, 352 may have compliant pins received in the vias 348.

Optionally, the wafer contacts 350 are tuning-fork style contacts including a socket configured to receive the wafer 320 therein. Other types of wafer contacts 350 may be provided in alternative embodiments. The wafer contacts 350 are configured to be terminated to the mating pads 327 (shown in FIG. 6) of the wafers 320. The wafer contacts 350 may terminate to one or both sides of the wafer 320. The wafer contacts 350 may create a compression connection to the wafer 320. The wafer 320 may be connected to the contact sub-assembly 340 by an interference connection. The wafer contacts 350 may be soldered to the wafers 320 in some embodiments.

Optionally, the mating contacts 352 are spring beam style contacts having a deflectable spring beam configured to be mated with the electrical connector 304, such as to wafers of the electrical connector 304. The mating contacts 352 may define separable interfaces with the wafers of the electrical connector 304. The mating contacts 352 may be other types of contacts in alternative embodiments. The mating contacts 352 may be configured to be terminated to other components in alternative embodiments.

In an exemplary embodiment, the contact sub-assembly 340 includes a front housing 360 extending from the second side 346 of the RPCB 342 and a rear housing 362 extending from the first side 344 of the RPCB 342. The front housing 360 extends to a front end 361. The front housing 360 holds the mating contacts 352. For example, the front housing 360 may include a plurality of contact channels that hold corresponding mating contacts 352. The front housing 360 includes a plurality of slots 364 configured to receive wafers of the second electrical connector 304. The mating contacts 352 are configured to be electrically connected to the wafers received in the slots 364 at separable interfaces of the mating contacts 352. The rear housing 362 may define a wafer housing that holds the wafer contacts 350. The rear housing 362 has a plurality of slots 366 at a rear end 368. Each slot 366 is configured to receive a corresponding wafer 320 of the wafer assembly 314. The wafer contacts 350 may be terminated to such wafers 320 within the slots 366.

In an exemplary embodiment, with reference to FIG. 3, the electrical connector 302 includes a secondary housing that acts as a spacer 370 at a front end of the contact sub-assembly 340 to space a sealing interface in proper position for an interfacial seal. The spacer 370 may be coupled to the front end 361 of the front housing 360. For example, the spacer 370 may be bonded to the front end 361. The spacer 370 may form part of the front housing 360. The spacer 370 provides a mating interface for the second electrical connector 304. Optionally, the second electrical connector 304 may be sealed against the spacer 370. The spacer 370 includes sealing surfaces 371 for sealing engagement with the second electrical connector 304. Optionally, the sealing surface 371 of the spacer 370 may be planar. Alternatively, the sealing surface 371 may have pockets and/or protrusions. In an exemplary embodiment, the spacer 370 includes a plurality of channels 372 that are configured to receive wafers of the electrical connector 304. The channels 372 allow the wafers to pass through to corresponding slots 364 of the front housing 360 for mating with the mating contacts 352.

Figure 9:
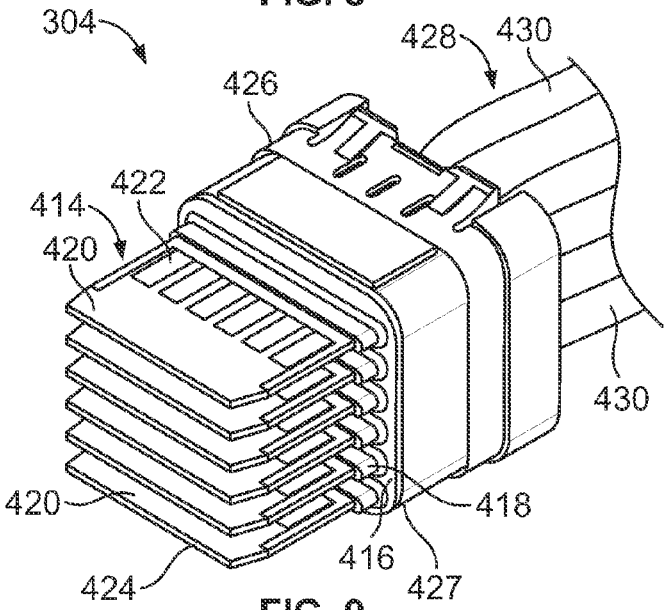
FIG. 9 illustrates a portion of an electrical connector of the connector system in accordance with an exemplary embodiment.

Returning to FIG. 2, and with additional reference to FIG. 9, which illustrates a portion of the electrical connector 304, the electrical connector 304 is configured to be mated with the electrical connector 302. The electrical connector 304 includes a shell 410 (FIG. 2) having a cavity 412. In an exemplary embodiment, the shell 410 is conductive and provides electrical shielding for the components therein. The shell 410 may be a die cast housing. Alternatively, the shell 410 may be plastic. The shell may define an outer housing of the electrical connector 304. A wafer assembly 414 is received in the cavity 412. The wafer assembly 414 includes a plurality of electrical wafers 420 stacked together and arranged parallel to each other within the cavity 412. Optionally, the electrical connector 304 may include a securing feature 411 for securing the electrical connector 304 to the electrical connector 302. The securing feature 411 may include a latch. The securing feature 411 may be slidably coupled to the shell 410 and may slide forward to latch or lock to the shell 310 of the electrical connector 302.

Optionally, the wafers 420 may be sealed at the shell 410. For example, the electrical connector 304 may include an interfacial seal 416 coupled to the wafer assembly 414. The interfacial seal 416 may seals against each of the wafers 420. The interfacial seal 416 may seal a perimeter of the wafer assembly 414. The interfacial seal 416 may seal to the shell 410. The interfacial seal 416 may seal against the electrical connector 302, such as against the spacer 370 (FIG. 3).

Each wafer 420 includes signal traces 422 on a signal layer of the wafer 420. The signal traces 422 may be exposed at or near one or both edges 424 of the wafer. The traces 422 may include pads for electrical terminations to the traces 422. The wafer 420 includes one or more ground layers which may be exposed at predetermined locations for electrical termination.

In an exemplary embodiment, the electrical connector 304 includes a wafer housing 426 configured to hold each of the wafers 420 of the wafer assembly 414. For example, the wafer housing 426 may hold the wafers 420 at predetermined spacing. The wafer housing 426 may have slots 423 that hold the wafers 420. The wafers 420 may be exposed in a rear pocket 425 at a rear end of the wafer housing 426. The wafer housing 426 is configured to be received in the shell 410. For example, the wafer housing 426 may be sized and shaped to fit in the cavity 412. The wafer housing 426 may be manufactured from a dielectric material, such as a plastic material. The interfacial seal 416 may seal against a front end 427 of the wafer housing 426. For example, the interfacial seal 416 may seal at the locations where the wafers 420 extend from the wafer housing 426.

The electrical connector 304 includes a flex harness 428 having a plurality of FPCBs 430. The FPCBs 430 may be similar to the FPCBs 330 (FIG. 6). The FPCBs 430 may be terminated to the wafers 420 in a similar manner as described above. For example, traces of the FPCB 330 may be soldered to corresponding traces of the wafers 420. The FPCB 330 may be sealed at the wafer 420, such as using a flex seal 480 (FIG. 10).

Figure 10:
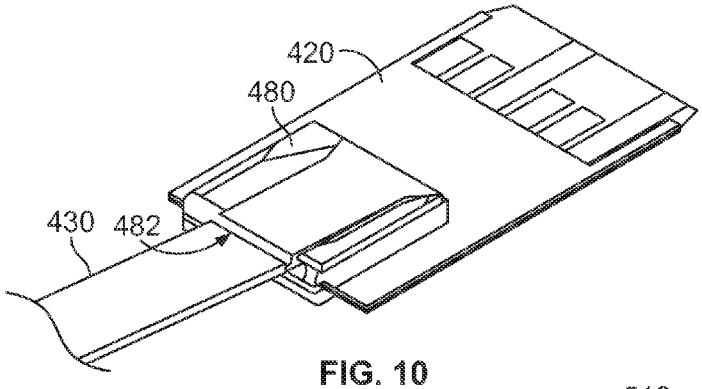
FIG. 10 is a rear view of a portion of the electrical connector in accordance with an exemplary embodiment.

FIG. 10 is a rear view of a portion of the electrical connector 304 showing one of the FPCBs 430 terminated to the corresponding wafer 420. The flex seal 480 provides sealing for the FPCB 430. In the illustrated embodiment, the flex seal 480 is a pre-molded seal or grommet that may be sealed against the FPCB 430 and the wafer 420. The grommet may provide an environmental seal for the PCBs 430. The grommet may provide strain relief for the FPCBs 430.

The flex seal 480 includes a slot 482 and the FPCB 430 is loaded through the slot 482. Optionally, the FPCB 430 may be fished through the slot 482 prior to being terminated to the wafer 420. The flex seal 480 may then be pushed forward into position and sealed against the wafer 420.

Optionally, the flex seal 480 may be mechanically secured to the wafer 420, such as being bonded to the wafer 420. The flex seal 480 may provide strain relief for the electrical connection between the FPCB 430 and the wafer 420. The flex seal 480 may be sized and shaped to fit into the wafer housing 426 (FIG. 9) and seal against the wafer housing 426 as the wafer 420 is loaded into the wafer housing 426. In other embodiments, the seal 480 may seal against the shell 410 (FIG. 2) in addition to or in the alternative to sealing against the wafer housing 426.

In an alternative embodiment, rather than individual flex seals sealed to each wafer 420 individually, the flex seal 480 is an end seal that seals the entire rear end of the electrical connector 304. For example, the flex seal 480 may be potting material filling the rear end of the shell 410. The potting material may be epoxy. The potting material may provide sealing and/or strain relief for the FPCBs 430. The flex seal 480 may seal to each of the wafers 420. The flex seal 480 may seal to each of the FPCBs 430. The flex seal 480 may seal to the shell 410. The FPCBs 430 exit the flex seal 480.

Figure 11:
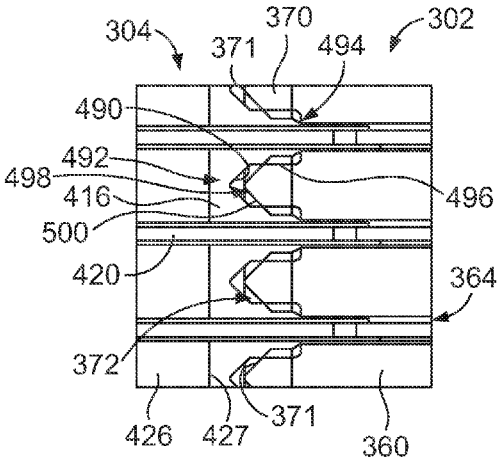
FIG. 11 is a cross sectional view of a portion of the connector system showing the electrical connector mated to the electrical connector in accordance with an exemplary embodiment.

FIG. 11 is a cross sectional view of a portion of the connector system 300 showing the electrical connector 304 mated to the electrical connector 302. During assembly, the electrical connector 304 is coupled to the electrical connector 302. The wafers 420 are loaded into the electrical connector 302 and mated to the contact sub-assembly 340. The mating contacts 352 are terminated to the pads of the traces 422 of the wafers 420. The FPCBs 430 are electrically connected to the FPCBs 330 via the contact sub-assembly 340.

With additional reference to FIG. 3, the interfacial seal 416 seals against the front end of the electrical connector 302. The interfacial seal 416 includes a front 490 and a rear 492 opposite the front 490. The rear 492 seals against the front end 427 of the wafer housing 426. The rear 492 may be fixed to the front end 427, such as being bonded or adhered to the front end 427. The interfacial seal 416 includes a plurality of slots 494 therethrough. The slots 484 receive corresponding wafers 420. In an exemplary embodiment, the interfacial seal 416 includes protrusions 496 extending forward of the front 490 with gaps 498 between the protrusions. The slots 494 are provided in corresponding protrusions 496.

In an exemplary embodiment, the protrusions 496 are configured to be received in corresponding channels 372 in the spacer 370 (or alternatively directly into the slots 364 in the front housing 360 when the spacer 370 is not used). The protrusions 496 seal against the sealing surface 371 of the spacer 370, such as interior of the channels 372. Optionally, the channels 372 may include lead-ins 500 for loading the protrusions 496 and wafers 420 therethrough.

Figure 12:
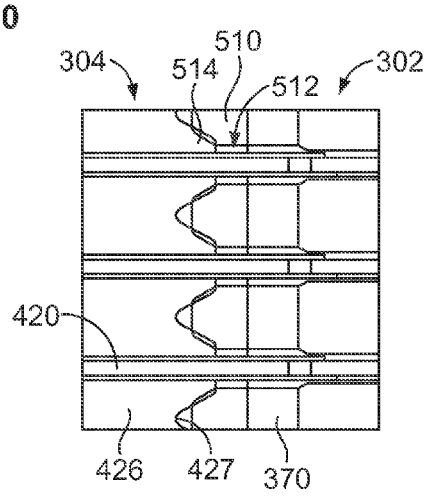
FIG. 12 is a cross sectional view of a portion of the connector system showing the electrical connector mated to the electrical connector in accordance with an exemplary embodiment.

FIG. 12 is a cross sectional view of a portion of the connector system 300 showing the electrical connector 304 mated to the electrical connector 302. FIG. 12 shows an alternative sealing arrangement where an interfacial seal 510 is provided on the electrical connector 302 (rather than on the electrical connector 304 as in FIG. 11). The interfacial seal 510 may be bonded or fixed to the spacer 370. The interfacial seal 510 includes slots 512 that receive the wafers 420 therethrough. Optionally, the interfacial seal 510 may seal to the wafers 420 around the slots 512. Alternatively, the slots 512 may be oversized such that the interfacial seal 510 does not engage the wafers 420, but rather the interfacial seal 510 is sealed against the front end 427 of the wafer housing 426. In the illustrated embodiment, the front end 427 of the wafer housing 426 includes protrusions 514. The protrusions 514 may be loaded into corresponding slots 514.

Figure 13:
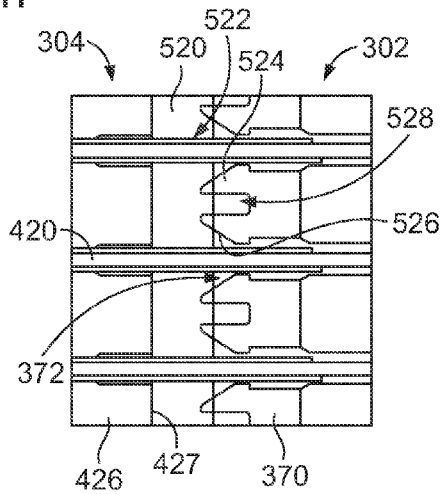
FIG. 13 is a cross sectional view of a portion of the connector system showing the electrical connector mated to the electrical connector in accordance with an exemplary embodiment.

FIG. 13 is a cross sectional view of a portion of the connector system 300 showing the electrical connector 304 mated to the electrical connector 302. FIG. 13 shows an alternative sealing arrangement where a compressing-type interfacial seal 520 is provided. The interfacial seal 520 is shown provided on the electrical connector 304; however the interfacial seal 520 may be provided on the electrical connector 302 in alternative embodiments. The interfacial seal 520 may be bonded or fixed to the front end 427 of the wafer housing 426. The interfacial seal 520 includes slots 522 that receive the wafers 420 therethrough. Optionally, the interfacial seal 520 may seal to the wafers 420 around the slots 522. The spacer 370 includes protrusions 524 configured to be pressed into the compression interfacial seal 520. The protrusions 524 may surround the channels 372 and may include lead-ins 526. The protrusions 524 may include pockets 528 that provide relief or a space for the compression interfacial seal 520 to fill when compressed.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112(f), unless and until such claim limitations expressly use the phrase "means for" followed by a statement of function void of further structure.

What is claimed is:

1. An electrical connector comprising:

a shell having a cavity;

a wafer assembly received in the cavity, the wafer assembly comprising a wafer housing holding a plurality of electrical wafers configured to be electrically mated to a mating connector, the wafer housing having a front end, the wafers extending forward from the front end and being arranged parallel to each other within the cavity, each wafer including a first edge and a second edge, each wafer including at least one trace between the first and second edges; and an interfacial seal along the front end, the interfacial seal being configured to seal against the mating connector when mated to the front end, the interfacial seal providing an environmental seal for the wafer assembly.

2. The electrical connector of claim 1, wherein the interfacial seal is sealed against each of the wafers of the wafer assembly.

3. The electrical connector of claim 1, wherein the interfacial seal is sealed against upper and lower surfaces of each of the wafers of the wafer assembly.

4. The electrical connector of claim 1, wherein the interfacial seal comprises a plurality of slots, the wafers pass through corresponding slots.

5. The electrical connector of claim 1, wherein the interfacial seal includes a plurality of protrusions, the protrusions extend along corresponding wafers, distal ends of the protrusions being configured to seal against the mating connector.

6. The electrical connector of claim 1, wherein the interfacial seal has a front and a rear, the rear sealing against the front end of the wafer assembly, the front being configured to seal against the mating connector.

7. The electrical connector of claim 1, wherein the interfacial seal is mounted to the front end over the wafers.

8. The electrical connector of claim 1, further comprising a flex harness comprising a plurality of flexible printed circuit boards (FPCBs), the FPCBs being electrically connected to corresponding wafers, wherein the FPCBs are directly terminated to the corresponding wafers.

9. The electrical connector of claim 8, wherein the FPCBs are soldered to the corresponding wafers.

10. The electrical connector of claim 8, wherein the FPCBs include flex seals sealed against the wafer housing and the corresponding FPCBs.

11. The electrical connector of claim 8, wherein the FPCBs each include a grommet provided at an end of the FPCB, the grommet being secured to the corresponding wafer to provide an environmental seal for the FPCB.

12. An electrical connector comprising:

a shell having a cavity;

a wafer assembly received in the cavity, the wafer assembly comprising a wafer housing holding a plurality of electrical wafers configured to be electrically mated to a mating connector, the wafer housing having a front end, the wafers extending forward from the front end and being arranged parallel to each other within the cavity, each wafer including a first edge and a second edge, each wafer including at least one trace between the first and second edges; and an interfacial seal along the front end, the interfacial seal being sealed against each of the wafers of the wafer assembly, the interfacial seal being configured to seal to the mating connector.

13. The electrical connector of claim 12, wherein the interfacial seal is sealed against upper and lower surfaces of each of the wafers of the wafer assembly.

14. The electrical connector of claim 12, wherein the interfacial seal comprises a plurality of slots, the wafers pass through corresponding slots.

15. The electrical connector of claim 12, further comprising a flex harness comprising a plurality of flexible printed circuit boards (FPCBs), the FPCBs being electrically connected to corresponding wafers, wherein the FPCBs are directly terminated to the corresponding wafers.

16. The electrical connector of claim 15, wherein the FPCBs include flex seals sealed against the wafer housing and the corresponding FPCBs.

17. An electrical connector comprising:

a shell having a cavity;

a wafer assembly received in the cavity, the wafer assembly comprising a wafer housing holding a plurality of electrical wafers configured to be electrically mated to a mating connector, the wafer housing having a front end, the wafers extending forward from the front end and being arranged parallel to each other within the cavity, each wafer including a first edge and a second edge, each wafer including at least one trace between the first and second edges; and a flex harness comprising a plurality of flexible printed circuit boards (FPCBs), the FPCBs being electrically connected to corresponding wafers and extending rearward from the cavity, the flex harness having a flex seal configured to be sealed to at least one FPCB.

18. The electrical connector of claim 17, further comprising an interfacial seal along the front end, the interfacial seal being configured to seal between the electrical connector and the mating connector, the interfacial seal providing an environmental seal for the wafer assembly.

19. The electrical connector of claim 17, wherein the flex seal seals the at least one FPCB to the corresponding wafer.

20. The electrical connector of claim 17, wherein the flex seal seals the at least one FPCB to at least one of the shell and the wafer housing.

21. The electrical connector of claim 17, wherein the flex seal includes a plurality of grommets provided at an end of the corresponding FPCB, the grommets being secured to the corresponding wafer to provide strain relief and sealing against the FPCB.

22. The electrical connector of claim 17, wherein the flex seal comprises potting material filling a rear end of the shell where the FPCBs exit the shell.

* * * * *